US005493884A

United States Patent [19]

Hinz et al.

[11] Patent Number: 5,493,884

[45] Date of Patent: Feb. 27, 1996

[54] KEY FOR LOCKING CYLINDERS, PARTICULARLY FOR LOCKING SYSTEMS

[75] Inventors: Manfred Hinz, Heiligenhaus; Hans-Dieter Baden, Velbert, both of Germany

[73] Assignee: BKS GmbH, Velbert, Germany

[21] Appl. No.: 329,537

[22] Filed: Oct. 26, 1994

[30] Foreign Application Priority Data

Oct. 26, 1993 [DE] Germany ..... 43 36 476.4

[51] Int. Cl.[6] ..... E05B 19/02

[52] U.S. Cl. ..... 70/407; 70/358; 70/403; 70/409

[58] Field of Search ..... 70/358, 407, 409, 70/493, 453, 454, 402–406, 420, 386, 401, 419, DIG. 37

[56] References Cited

U.S. PATENT DOCUMENTS

| | | | |
|---|---|---|---|
| 707,757 | 8/1902 | Bryda | 70/409 |
| 857,439 | 6/1907 | Calicchio | 70/453 |
| 925,122 | 6/1909 | Merlonetti | 70/409 |
| 1,459,290 | 6/1923 | Habenicht | 70/409 |
| 1,793,432 | 2/1931 | Sczepczenski | 70/407 |
| 3,817,066 | 6/1974 | Pearson | 70/419 X |
| 5,131,249 | 7/1992 | Baden et al. | 70/407 X |

FOREIGN PATENT DOCUMENTS

| | | | |
|---|---|---|---|
| 157 | 2/1799 | France | 70/409 |
| 119591 | 4/1901 | Germany | 70/403 |
| 224185 | 7/1910 | Germany | 70/409 |
| 642131 | 2/1937 | Germany | 70/409 |
| 4035934 | 6/1991 | Germany | 70/358 |
| 144705 | 1/1921 | United Kingdom | 70/407 |

*Primary Examiner*—Lloyd A. Gall
*Attorney, Agent, or Firm*—Charles A. Wilkinson

[57] ABSTRACT

A key for a rotationally adjustable cylinder core (4) with a lock cylinder (3) containing a cryptochannel (11) freely leading into the peripheral area of the cylinder core (4) and, more particularly, to a key for a cylinder core of locking systems, which is provided with a profiled region (15), which is provided with lateral recesses (such as 17, 18), facing the back of the key that is flush with the peripheral area of the cylinder core when the key is inserted, and with a notched region (13), which faces the opposite key breast, can be inserted into the central cylinder core region of the cryptochannel (11), has a round, cylindrical and, particularly, a circular, cylindrical shape, as well as milled slots, depressions or similar notches (16) disposed peripherally and axially offset in the key for arranging tumbler elements (8), which are mounted in the lock cylinder (3) and can be adjusted radially to the core center of the lock cylinder (3). In order to impart even greater stability and provide an even larger peripheral surface for accommodating even more recesses and in order to avoid sharp edges in the region of the back of the key, the profiled region (15) of the key as well as the notched region (13) of the key has a round, cylindrical and, particularly, a circular, cylindrical shape and is connected with the notched region (13) by way of a waist region (14), which is short yet narrow.

20 Claims, 3 Drawing Sheets

KEY FOR LOCKING CYLINDERS, PARTICULARLY FOR LOCKING SYSTEMS

Figure 1:
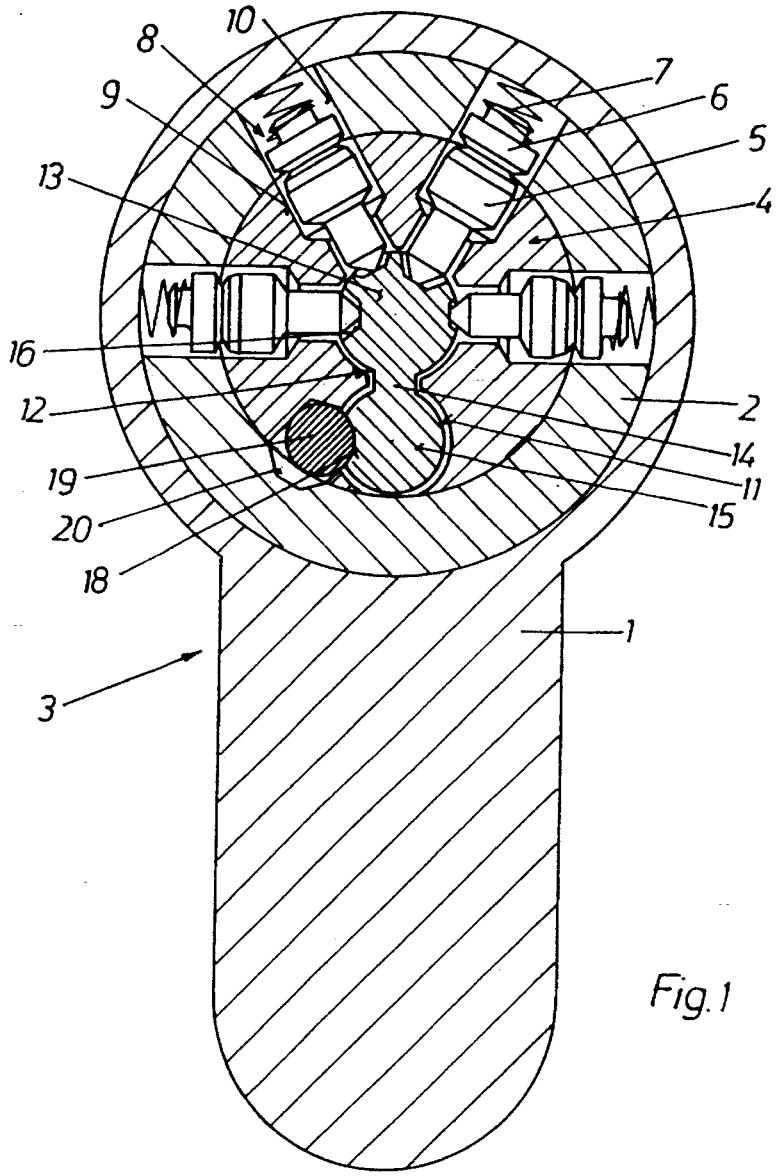

The invention relates to a key for a rotationally adjustable cylinder core with a lock cylinder containing a cryptochannel freely leading into the peripheral area of the cylinder core and, more particularly, to a key for a cylinder core of locking systems, which is provided with a profiled region, which is provided with lateral recesses, facing the back of the key that is flush with the peripheral area of the cylinder core when the key is inserted and with a notched region, which faces the opposite key breast, can be inserted into the central cylinder core region of the cryptochannel, has a round, cylindrical and, particularly, a circular, cylindrical shape, as well as milled slots, depressions or similar notches, disposed peripherally and axially offset in the key for arranging tumbler elements, which are mounted in the lock cylinder and can be adjusted radially to the core center of said lock cylinder.

Lock cylinder keys of the above type are known, for example, from the European publication 0 436 496 A1. They differ from other keys primarily owing to the fact that their round, cylindrical, notched region, which is wider than the profiled region, has great stability and permits a plurality of depressions or similar notches to be provided for arranging the cylinder tumbler elements. The profiled region, which is kept comparatively narrower, has two side surfaces, which run parallel to one another and into which a larger number of profiling, longitudinal grooves are to be worked, which can also be provided at varying places. Occasionally, openings, in which feelers for the control of additional tumbler pins movably mounted in the cylinder core and cylinder housing, can also be present in the profiled region of these keys. Because of its narrow profiled region, which is bounded by essentially parallel surfaces, the previously known cylinder key leaves something to be desired with respect to stability and also permits only a limited number of recesses to be provided laterally therein. In addition, these keys always have sharp edges in the profiled region.

It is therefore an object of the invention to improve and perfect a key of the initially-mentioned type, so that it has an even greater stability as well as an even greater peripheral surface for accommodating even more recesses and finally also is, in particular, more user friendly, since it does not have any sharp edges, at any rate not in the region of its back.

Starting out from a cylinder key of the previously mentioned type, this objective is accomplished pursuant to the invention owing to the fact that the profiled region of the key, as well as the notched region of the key, has a round, cylindrical and, in particular, a circular, cylindrical shape and is connected with the notched region over a waist region, which is shorter yet narrower. In this way, one arrives, as it were, at a double-bellied key which, due to its shape, which is round, cylindrical also in the profiled region, has a greater stability as well as an enlarged surface area, which enables a greater number of recesses to be incorporated. Moreover, such a key is largely free of sharp edges, at least in the region in the vicinity of its back.

The cylinder key can be provided in its round, cylindrical, profiled region with longitudinal profiling grooves and/or also additional recesses for releasing the entry of additional locking bodies present in the cylinder core, for example, in the form of locking spheres or locking rollers. Variable longitudinal profiling grooves can, moreover, also be provided in the waist region of the key.

The round, cylindrical, profiled region of the key can have a smaller diameter than the round, cylindrical, notched region. However, both can also have the same diameter. In the latter case, the cylinder key can also be constructed as a reversible key, which has the same notches in its profiled region as in its notched region in an arrangement symmetrical to its central reversing axis.

It is important, particularly for such reversible keys, that the key stop, which limits the depth of insertion in the cryptochannel of the lock cylinder, lies pursuant to the invention in the waist region of the key within the end plane region of the associated lock cylinder core. In this way, it is ensured that, independently of the position of insertion of the reversible key, the key stop always lies against the end plane of the cylinder core and not against the end plane of the cylinder housing, which need not necessarily always be flush with the end plane of the cylinder core. Such a key stop can be constructed as a square body inserted in a round recess present on one side in the waist region of the key. It can, however, also consist of a through-bolt, which passes through a transverse borehole in the key shaft and projects from both sides of it.

Several embodiments of the invention are shown in the drawing, in which

Figure 2:
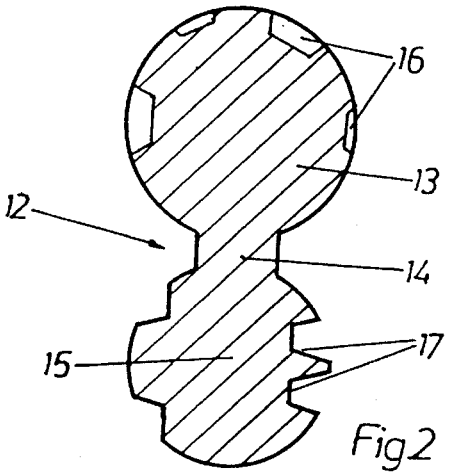
Figure 3:
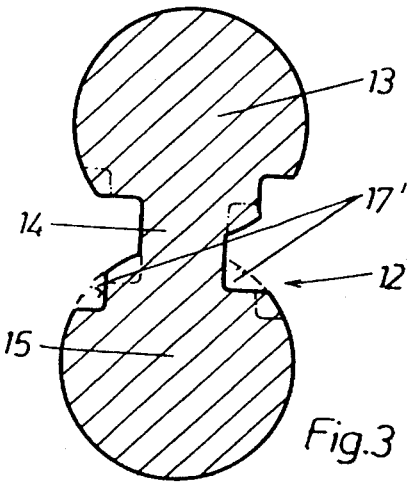
Figure 4:
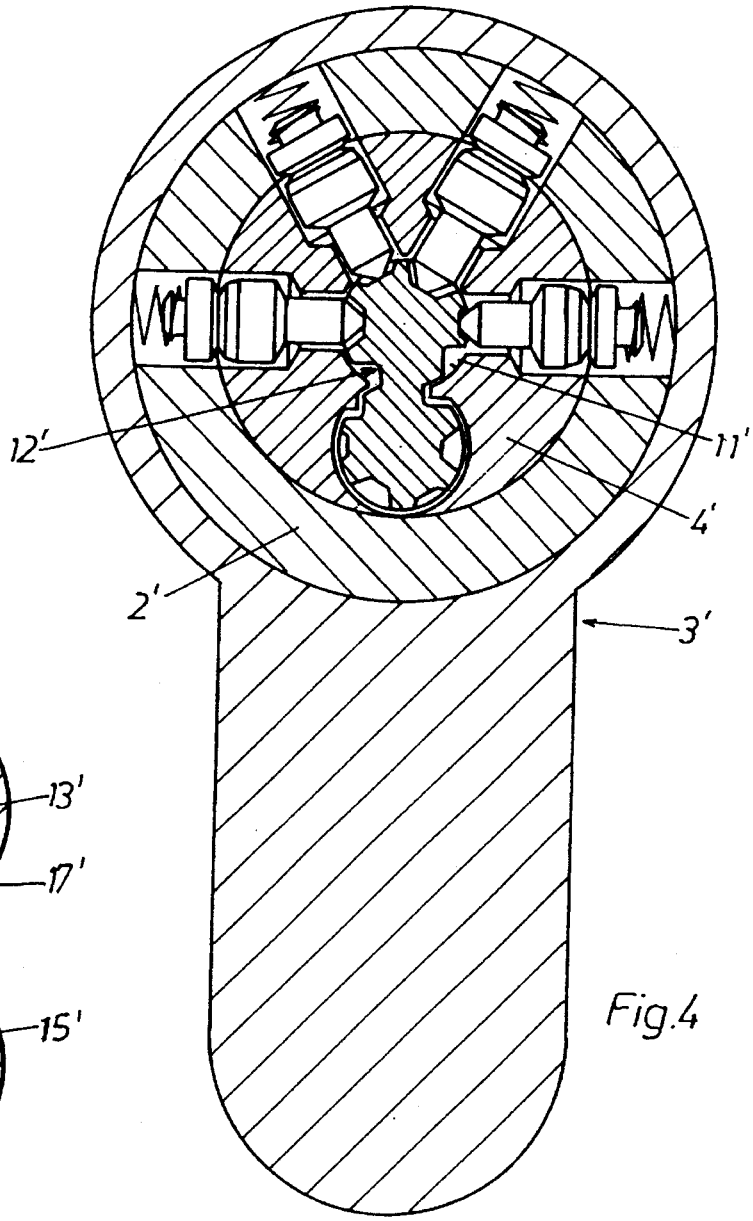
Figure 6:
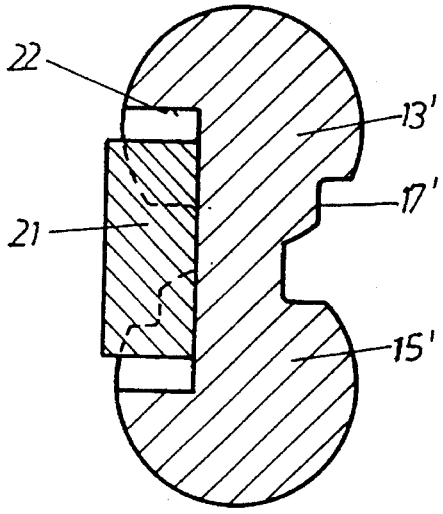
Figure 5:
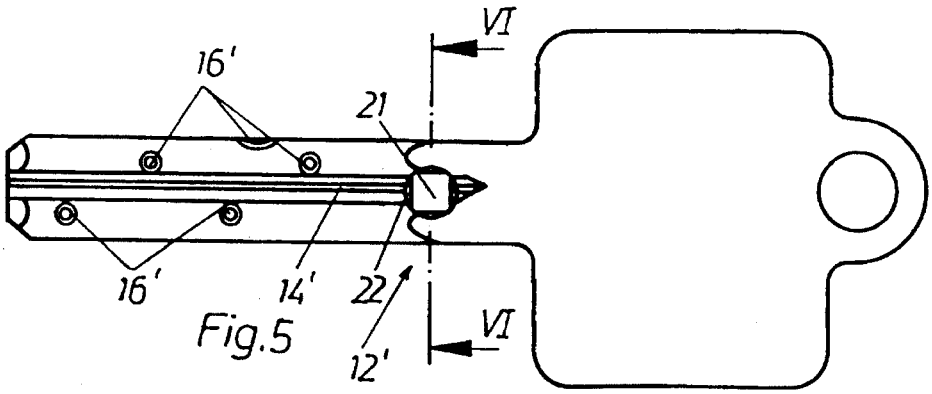
Figure 7:
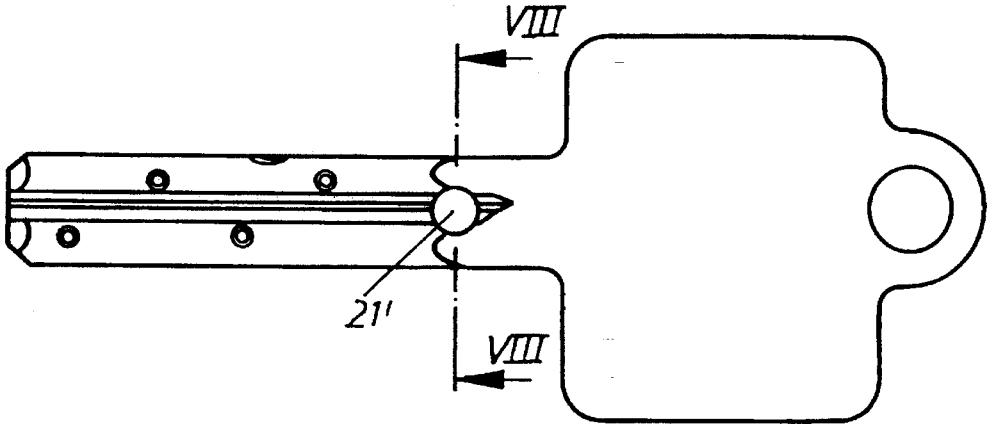
Figure 8:
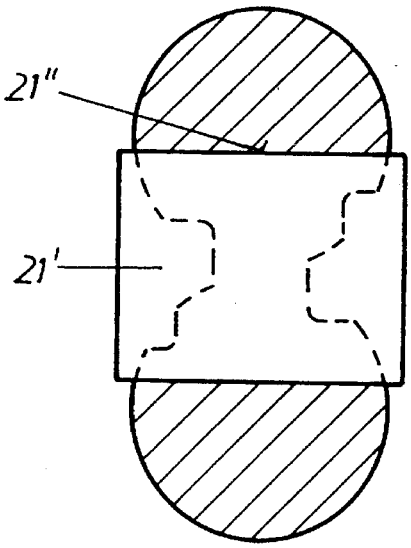
Figure 9:
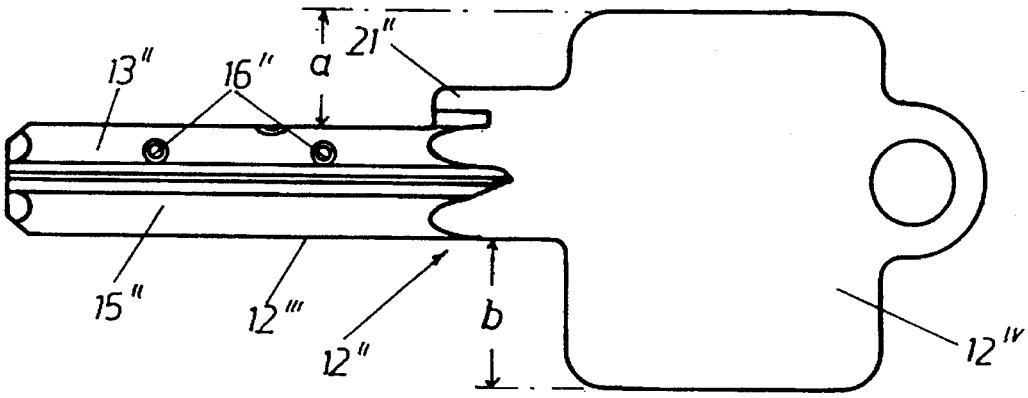

FIG. 1 shows a transverse section through a lock cylinder, in which a double-bellied key is inserted, FIGS. 2 and 3 show sections through further, double-bellied cylinder keys, FIG. 4 shows a section through a lock cylinder, in which a cylinder key, constructed as a reversible key is inserted, FIG. 5 shows a reversible key in side view, FIG. 6 shows a section along the line VI—VI of FIG. 5, FIG. 7 shows a reversible key with a key stop on both sides, FIG. 8 shows a section along the line VIII—VIII of FIG. 7 and FIG. 9 shows a double-bellied cylinder key with a conventional key stop.

The profiled lock cylinder 3, shown in FIG. 1, has a cylinder housing, consisting of the mutually inserted parts 1 and 2, as well as a cylinder core 4, which is supported therein so that it can be rotated. This core 4 is to be blocked in a known manner when the key is withdrawn by means of the tumbler elements 8, which are aligned radially to the center of the core and consist in each case of core and housing pins 5 and 6 and the compression springs 7 in corresponding boreholes 9 and 10. The core 4 has a cryptochannel 11 leading freely into its peripheral surface.

The cylinder key 12, which is to be inserted into the channel 11, has a circular, cylindrical, notched region 13 and a profiled region 15, which is connected with the notched region 13 over a narrow and short waist region 14. The notches 16, assigned to the tumblers 8, are incorporated in an appropriate circumferentially and axially offset arrangement in the notched region 13, for example, in the form of appropriate milled slots. By these means, when the fitting key 12 is inserted into the cryptochannel 11 of the lock cylinder core 4, the tumbler elements 8 can be pushed into the release position shown, so that the cylinder core 4 can then be rotated appropriately in order to actuate the lock.

In the present case, the profiled region 15 of the key is somewhat smaller in diameter than the notched region 13 and can be provided, for example, with longitudinal profiling grooves 17, which can be varyingly installed at different places, as shown in FIG. 2. However, recesses 18, for releasing the entry of additional locking bodies present in the cylinder core 4 in the form, for example, of the locking spheres 19 shown, can also be present in the profiled region 15, as shown in FIG. 1. Instead of having the shape of a spherical segment, the recess 18 could equally well be circular cylindrical and, with that, accommodate a locking roller conformed according to the locking sphere 19. Normally, the locking sphere 19 protrudes into the recess 20 present in the housing part 2. However, when the fitting key 12 is inserted and the core 4 is rotated at the same time, the locking sphere 19 can enter the recess 18 in the profiled region 15 of the key 12 and, by these means, release the cylinder core 4 in much the same way as the remaining tumbler elements 8 of the cylinder core for its rotational displacement.

As shown in FIG. 3, the double-bellied cylinder key can also be provided with longitudinal profiling grooves 17' at or in the vicinity of the waist region 14. As shown by the lines of dots and dashes, these longitudinal profiling grooves 17' can be disposed at different places and in different shapes, thus providing a further profile variation in this region of the key. Moreover, the key in FIG. 3 has notched and profiled regions 13, 15, which are equally large in diameter, so that such a key can also be used as reversible key, provided that the notches and/or profiled grooves in the two regions coincide and are disposed symmetrically to one another with respect to the longitudinal reversing axis of the key.

Such a reversing key 12', provided with a notched region 13 and a profiled region 15, which are equally large in diameter, and having the corresponding notches disposed symmetrically to one another in the two regions is shown in FIG. 4 together with a lock cylinder 3', which accommodates the reversible key 12' and has an appropriately profiled cryptochannel 11'. FIGS. 5 and 6 also show a reversible key provided with appropriate notches 16', which are present symmetrically. The key stop 21, present in order to limit the depth of insertion of the reversible key 12', is disposed here in the waist region 14' of the key and, moreover, in such a manner that, as can be seen in FIG. 6, the stop 21 still lies within the end plane region of the associated key cylinder core 4'. By these means, it is ensured that, independently of the reversible insertion of the key 12', the key stop 21 always comes to lie against the end plane of the cylinder core and not against the end plane of the cylinder housing part 2', which possibly protrudes beyond the end plane of the cylinder core. In the case of FIGS. 5 and 6, the key stop 21 is constructed as a square body, which is inserted or clamped in a round recess 22 present in the waist region 14' of the shaft of the key. The stop body 21, however, can be glued equally well also into the round recess 22 of the shaft of the key.

A further embodiment of the key stop for a reversible key is shown in FIGS. 7 and 8. The stop consists here of a cylindrical through-bolt 21', which passes through a borehole 21' present in the key shaft, protruding from it on both sides. In this case also, it is ensured that the through-bolt 21', serving as stop, still lies within the profile of the core of the lock cylinder.

In deviation from this, a double-bellied cylinder key 12", which is not constructed as a reversible key, is shown in FIG. 9. This cylinder key 12" has differently constituted notched regions 13" and profiled regions 15" and is provided with a conventionally constructed and disposed key stop 21". The key stops 21 or 21' in the waist region of the key, present in the previously mentioned cases, could, however, also equally well be used for this cylinder key 12", which is not suitable as a reversible key. In such a case, however, the key shaft 12''' must not lie centrally with respect to the key head $12^{IV}$, but must lie asymmetrically with respect to it, corresponding to the different distances a, b, so that the user does not insert the key the wrong way around in the cryptochannel of the lock cylinder.

It is self-evident that, for the sake of simplicity, the notches 16' or profiled grooves 17', present in the notched region 13' or the profiled region 15', have been omitted in most of the cases shown, for example, in FIGS. 6 and 8. What is essential is the inventive, double-bellied, profiled shape of the cylinder key, by means of which said key gains increased stability and, at the same time, a greater possibility for accommodating further tumbler notches and longitudinal profiled grooves. In particular, the key also has no sharp edges whatsoever in the region of the back of the key and consequently is also correspondingly user friendly.

We claim:

1. A key for use in a rotatable cylinder core lock having adjacent connected channels into which the key is inserted for operation of the lock comprising:

(a) a key shaft having an enlarged upper section and a parallel enlarged lower section connected by a web extending between the two sections, (b) the parallel enlarged upper and lower sections being generally cylindrical in shape, (c) lock tumbler accommodating slots disposed in the enlarged upper section, (d) lateral recesses accommodated in the enlarged lower section, and (e) the connecting web between the upper and lower sections being relatively short and narrow relative to the upper and lower sections.

2. A key in accordance with claim 1 additionally comprising:

(f) longitudinal profiled grooves in the lower section for interaction with locking spheres or rollers present in a matching core of a lock.

3. A key in accordance with claim 2 additionally comprising:

(g) longitudinal profiled grooves in the web.

4. A key in accordance with claim 3 wherein the lower section has a smaller diameter than the upper section.

5. A key in accordance with claim 3 wherein the upper and lower sections of the key have the same diameter.

6. A key in accordance with claim 5 wherein notches in the lower section and the upper section are arranged symmetrically with respect to a central axis of the key.

7. A key in accordance with claim 6 additionally comprising:

(h) a keystop positioned in a rearward web region of the key.

8. A key in accordance with claim 7 wherein the keystop comprises a substantially square body positioned in a round recess on one side of the web.

9. A key in accordance with claim 7 wherein the keystop extends transversely through the web region.

10. A key in accordance claim 5 wherein a head of the key is secured to the key shaft asymmetrically.

11. A key for use in a rotationally adjustable cylinder core within a lock cylinder containing a cryptochannel extending into a peripheral area of the cylinder core and, wherein the key is provided with a shaft including a profiled region having lateral recesses facing one side of the key that are flush with the peripheral area of the cylinder core when the key is inserted in the core, and with a notched region, for insertion into a central cylinder core region of the cryptochannel and having a round, cylindrical and, particularly, a circular, cylindrical shape, as well as milled slots or depressions or similar notches disposed peripherally and axially offset in the key for arranging tumbler elements, which are mounted in the lock cylinder and which can be adjusted radially to the central cylinder core region of said lock cylinder, characterized in that the profiled region of the key as well as the notched region of the key has a round, cylindrical and, particularly, a circular, cylindrical shape and is connected with the notched region by way of a waist region, which is short yet narrow.

12. The key of claim 11, characterized in that it is provided in its round, cylindrical, profiled region with longitudinal, profiled grooves or recesses for releasing the entry of locking bodies, additionally present in the cylinder core, in the form of locking spheres or locking rollers.

13. The key of claim 12, characterized in that it is provided also in its waist region with, particularly variable, longitudinal, profiled grooves.

14. The key of claim 13, characterized in that its round, cylindrical, profiled region has a diameter, which is smaller than the diameter of its round, cylindrical, notched region.

15. The key of claim 13, characterized in that its round, cylindrical, profiled region has the same diameter as its round, cylindrical, notched region.

16. The key of claim 15, characterized in that it is constructed as a reversible key, which has the same slots or depressions or notches in its profiled region and its notched region, arranged symmetrically with respect to its central axis of reversal.

17. The key of claim 16 having a key stop limiting the depth of insertion of the key in the cryptochannel of the lock cylinder, characterized in that the key stop is in the waist region of the key within an end plane region of the associated cylinder core.

18. The key of claim 17, characterized in that the key stop is constructed as a square body inserted in a round recess present on one side in the waist region of the key.

19. The key of claim 17, characterized in that the key stop is constructed as a transverse member passing through a transverse borehole in the key shaft and protruding from it on both sides.

20. The key of claim 15, characterized in that the key shaft is disposed asymmetrically to a key head.

* * * * *